US006848597B2

(12) United States Patent
Vlodek

(10) Patent No.: US 6,848,597 B2
(45) Date of Patent: Feb. 1, 2005

(54) METHODS AND APPARATUS FOR EXTRUDING FOAM THROUGH ORIFICES

(76) Inventor: James A. Vlodek, 10950 Linn Ct., LaGrange, IL (US) 60525

( * ) Notice: Subject to any disclaimer, the term of this patent is extended or adjusted under 35 U.S.C. 154(b) by 0 days.

(21) Appl. No.: 10/125,041

(22) Filed: Apr. 18, 2002

(65) Prior Publication Data

US 2002/0153390 A1 Oct. 24, 2002

Related U.S. Application Data

(60) Provisional application No. 60/284,693, filed on Apr. 18, 2001.

(51) Int. Cl.[7] ..... B67D 3/00
(52) U.S. Cl. ..... 222/78; 222/402.13; 446/475
(58) Field of Search ..... 222/78, 190, 402.13; 446/74, 475

(56) References Cited

U.S. PATENT DOCUMENTS 3,958,726 A * 5/1976 Trotta ..... 222/402.13
4,791,723 A * 12/1988 Jacobson ..... 222/402.13
4,901,891 A * 2/1990 Goncalves ..... 222/402.13
D315,581 S 3/1991 Valkner
5,230,648 A * 7/1993 Kelley et al. ..... 446/74
5,915,597 A * 6/1999 De Laforcade ..... 222/402.13
6,425,498 B1 * 7/2002 Gheorgheos ..... 222/78

* cited by examiner

*Primary Examiner*—Philippe Derakshani
(74) *Attorney, Agent, or Firm*—Perry Hoffman

(57) ABSTRACT

A method and apparatus for extruding foam through an orifice, including a foam canister, a nozzle attached to the foam canister, an actuator attached to the foam canister, a cover secured to the soap foam canister having one or more orifices on the outer surface of the cover. The apparatus includes a plurality of selectable extrusion attachments operable with the nozzle. A method of extruding foam through orifices provides ornamental foam canister having the cover actuator thereon in which foam expelled into the void of the cover further extruding foam components through one or more orifices therein from which the extruded foam may be shaped for child play activities.

4 Claims, 8 Drawing Sheets

Fig. 2A
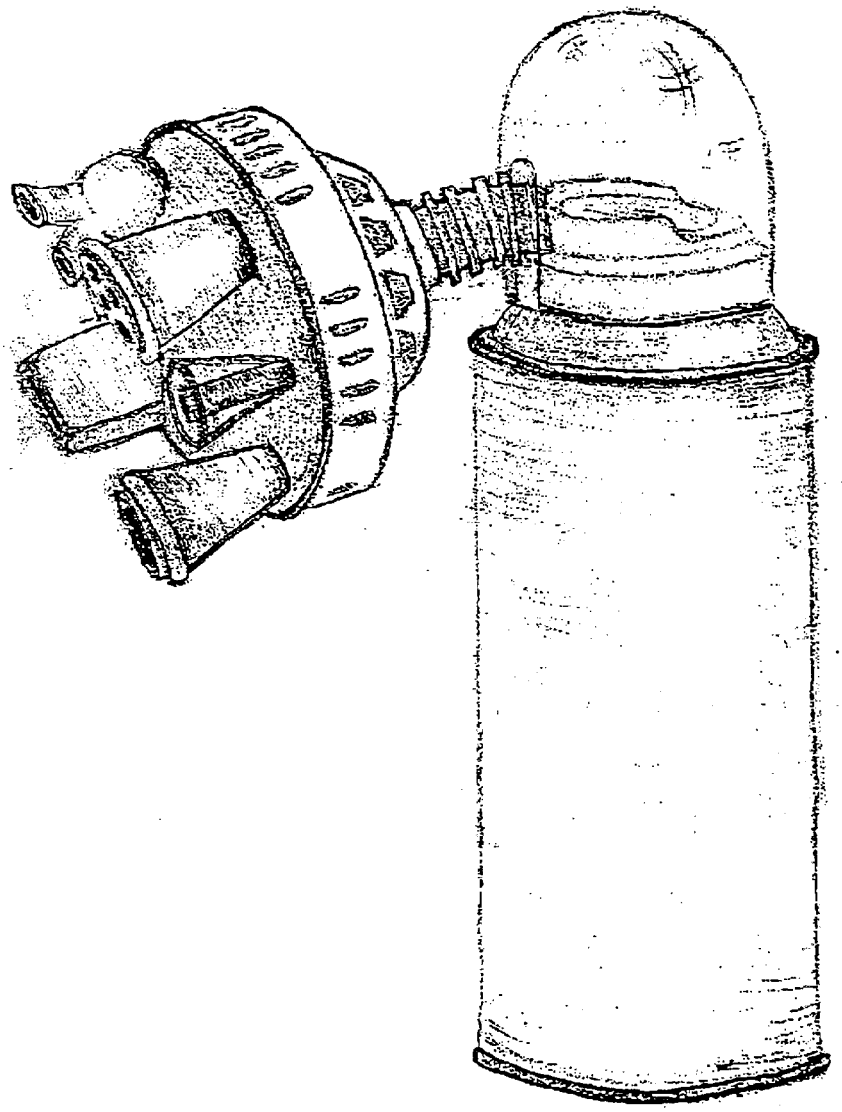
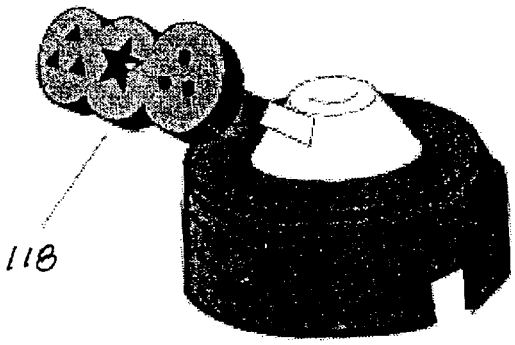
Fig. 2C

METHODS AND APPARATUS FOR EXTRUDING FOAM THROUGH ORIFICES

CROSS-REFERENCE TO RELATED APPLICATIONS

This application claims benefit of U.S. Provisional Application No. 60/284,693, filed Apr. 18, 2001.

BACKGROUND OF THE INVENTION

The present invention relates to extruding foam through one or more orifices, and more particularly relates to bath amusement apparatus for extruding foam soap for creative child play, allowing for the use of the extruded foam as a plaything or for use in constructive play.

It will be appreciated that the invention may be embodied in a wide variety of apparatus, those being shown in the drawings as illustrative rather than limiting. The extruded foam may be provided in various consistencies allowing for the child play using a thick texture foam as either an end product or the foam as material for building play activity such as creating shapes with the extruded foam during play. It will be appreciated that the extruded foam can be provided in a variety of different shapes, and may be provided with a soap factory or the like as illustrated in the drawings.

Briefly summarized, the invention relates to a method and apparatus for extruding foam through an orifice, including a foam canister, a nozzle attached to the foam canister, an actuator attached to the foam canister, a cover secured to the soap foam canister having one or more orifices on the outer surface of the cover. The cover is in mechanical communication with the actuator for dispensing foam from the foam canister through the nozzle into an interior void of the cover, which further extrudes the foam through the one or more orifices thereon. The apparatus includes a plurality of selectable extrusion attachments operable with the nozzle. A method of extruding foam through orifices provides the ornamental foam canister having the cover actuator thereon in which foam expelled into the void of the cover further extruding foam components through one or more orifices therein from which the extruded foam may be shaped for child play activities.

BRIEF DESCRIPTION OF THE DRAWINGS

FIG. 2A shows a single accessory providing multiple extrusions with a rotation selector, and FIGS. 2B and 2C illustrate further embodiments of such apparatus and attachments;

DESCRIPTION OF THE PREFERRED EMBODIMENTS

Figure 1C:
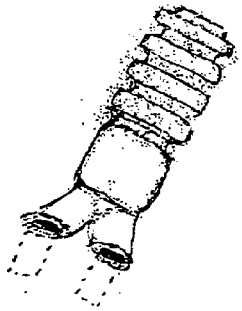
FIGS. 1A through 1F show soap foam containers for use with child bath activities incorporating adapters and accessories in accordance with the invention.
Figure 1D:
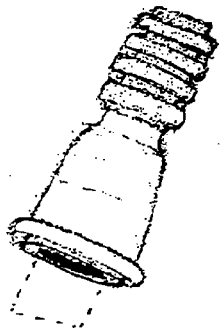
Figure 1E:
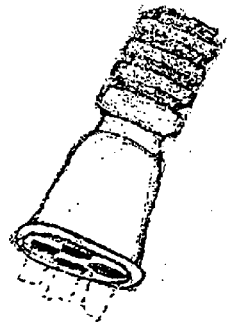
Figure 1F:
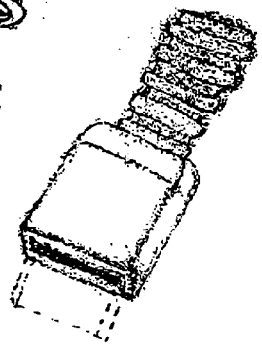
Figure 1A:
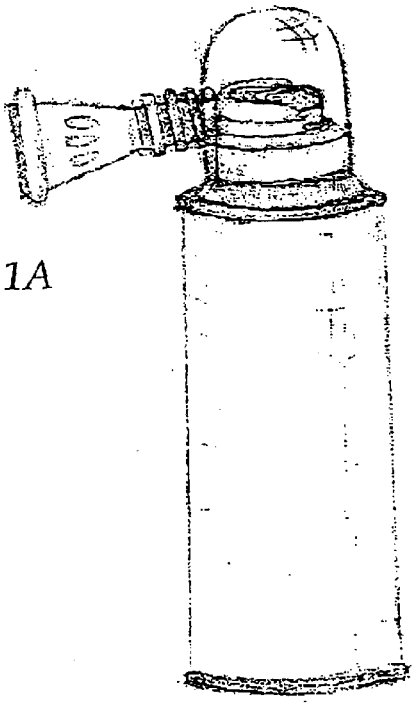
Figure 1B:
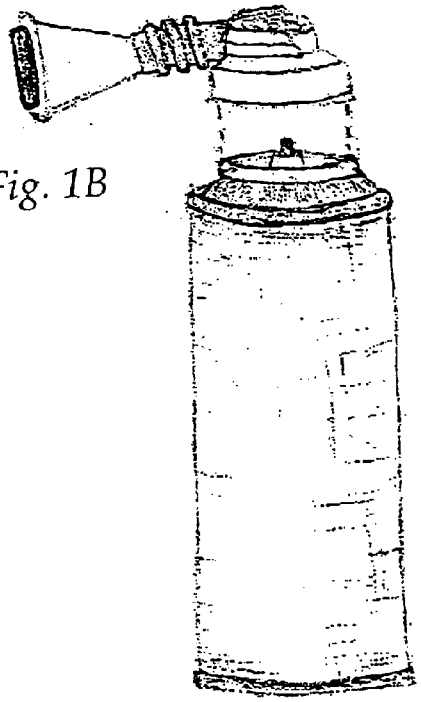

With reference to the figures and particularly FIGS. 1A through 1F, foam containers are illustrated such as a soap foam for use with child play and bath activities incorporating individual adapters for various shaped foam extrusion, FIG. 1A illustrating the assembled apparatus, FIG. 1B showing the attachment of the cap, and FIGS. 1C through 1F showing various extruded shapes, forms, and multiple extrusions.

Figure 2B:
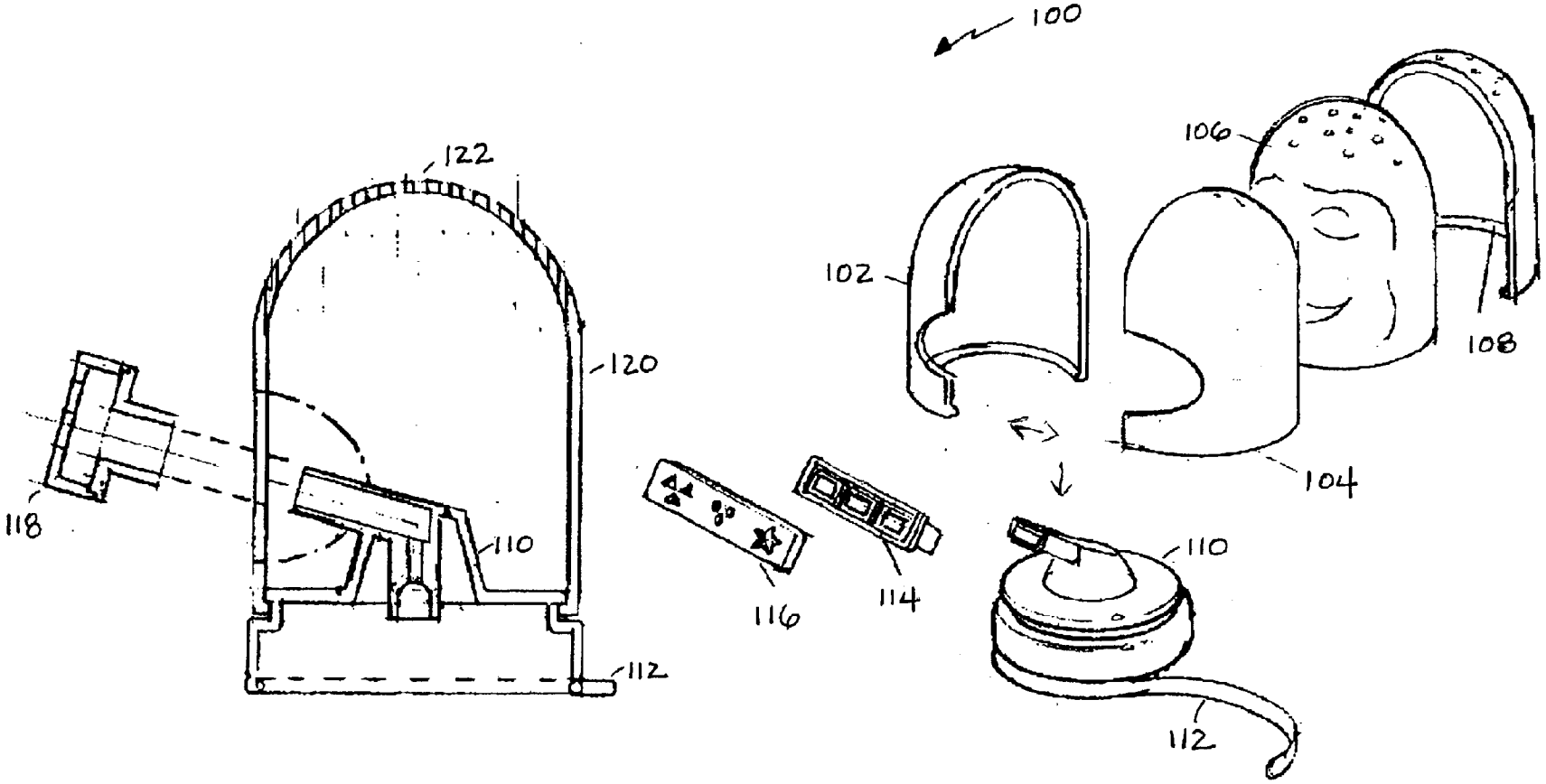

FIGS. 2A, 2B, and 2C illustrate various embodiments of the apparatus and attachments in which multiple extrusion shapes are provided with an ability to select the desired extrusion.

With reference to FIG. 2B, the cover/actuator assembly is illustrated generally at 100. Herein, the cover provides both the function of sealing the soap product cannister and providing, e.g., a character head assembly which may be formed in half portions as illustrated in a side-to-side shell assembly as shown in half 102 being adhered to half 104, or alternatively a front back manufacturer with half 106 and half 108. The cover may then be secured atop the foam nozzle assembly 110 which snaps on to the lip of the nozzle 110, which therebelow provides a pull tab or other nozzle securing means 112 which inhibits the operation of the nozzle 110 prior to the pull tab being removed or pealed off for operation so as to prevent actuation of the nozzle actuator prior to sale. In addition to the extrusion assemblies as discussed above, e.g., in connection with FIG. 2A, alternate extrusion assembly 114 and 116 are provided to provide various shapes. In addition, as shown in FIG. 2C, the extrusion assembly 118 may be used in connection with the nozzle 110.

Figure 5C:
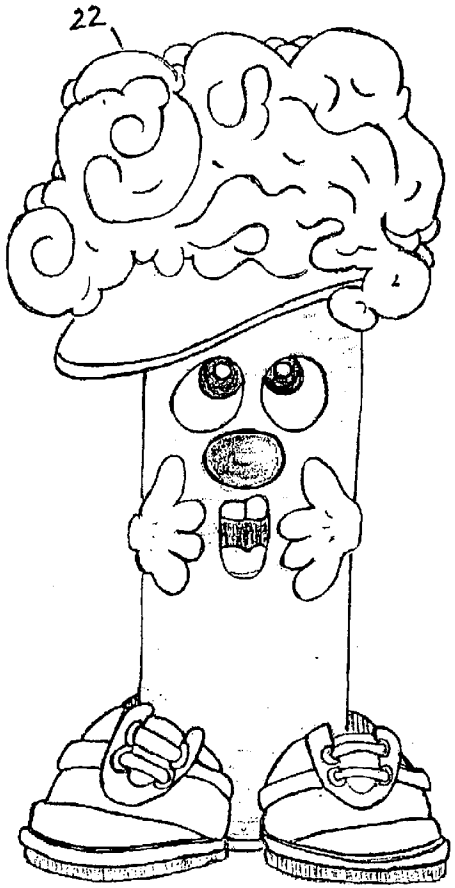
FIGS. 5A through 5E are further embodiments illustrating the child play and bath activities.
Figure 5B:
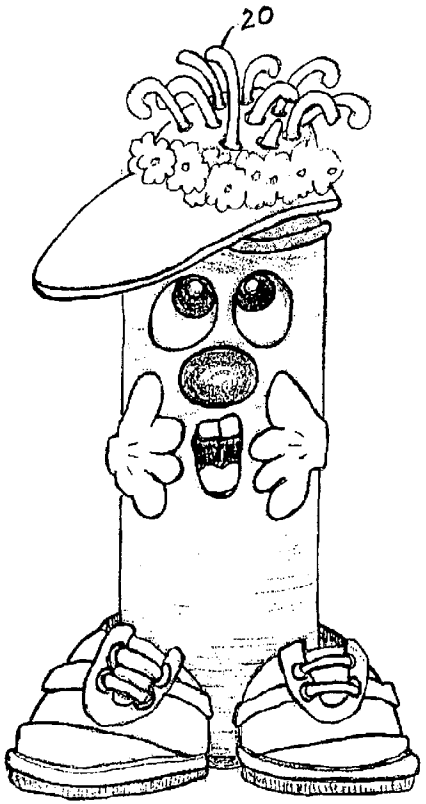
Figure 5A:
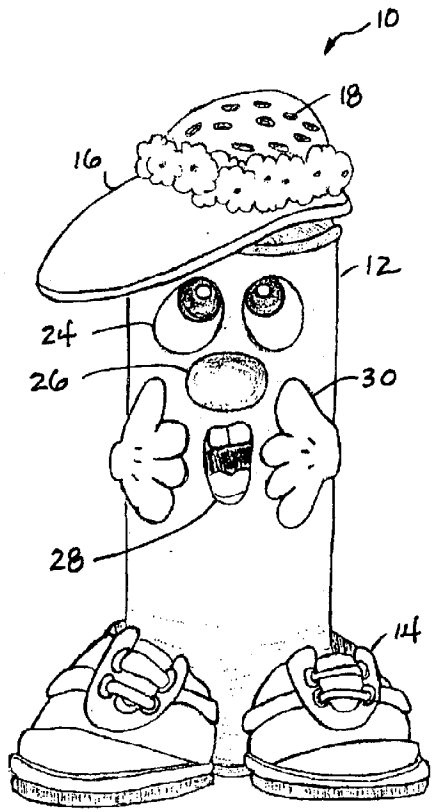
Figure 5D:
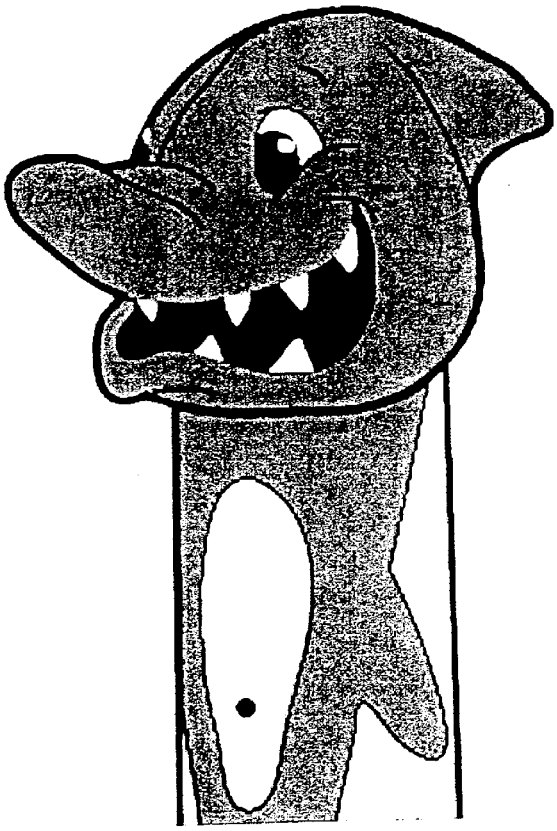
Figure 5E:
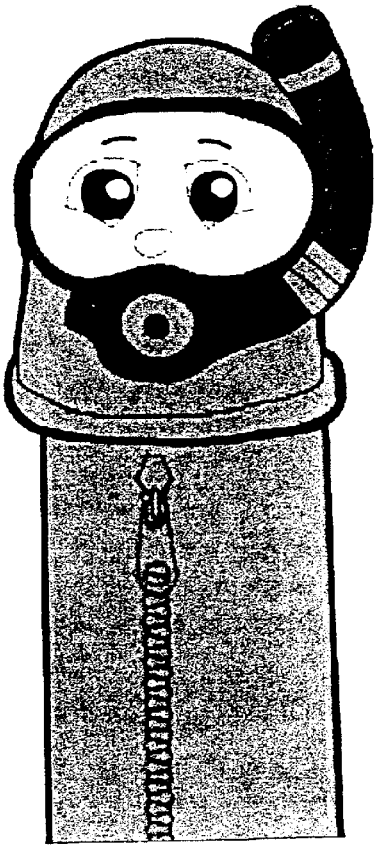

With reference to the cross-sectional view in FIG. 2B, the nozzle 110 receives the plug on shaped extruder 118 through the mouth placement of the cover, herein 120, which further includes apertures 122 as discussed further below. It will be appreciated that the release of the soap foam via the actuator of the nozzle 110 fills the void of the cap 120 with the soap foam product which, upon further actuation by further depressing the cap 120, extrudes foam through the mouth placement of the cover. With reference to FIGS. 5A–5C, the apertures 122 or the like are provided to provide hair-type extrusion. In addition, FIGS. 5D and 5E illustrate a shark and scuba diver cover respectively, with mouth portions through which the foam is extruded from the cover upon actuation.

Figure 3:
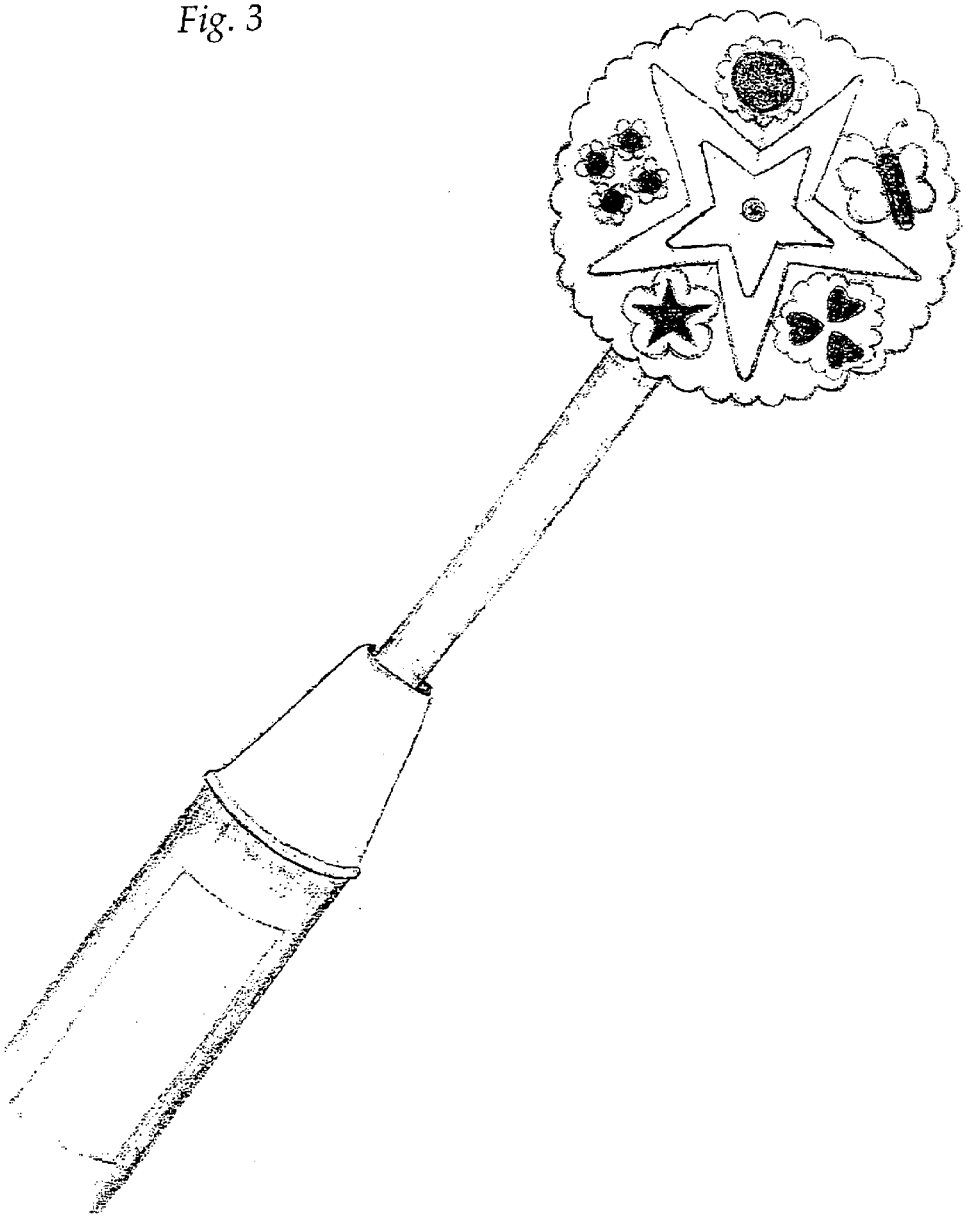
FIG. 3 illustrates an alternate embodiment in a wand apparatus.

FIG. 3 illustrates an alternate embodiment in a wand apparatus with multiple extrusions for providing various shaped foam extrusions for child play providing multiple extrusions with a rotation selector.

Figure 4:
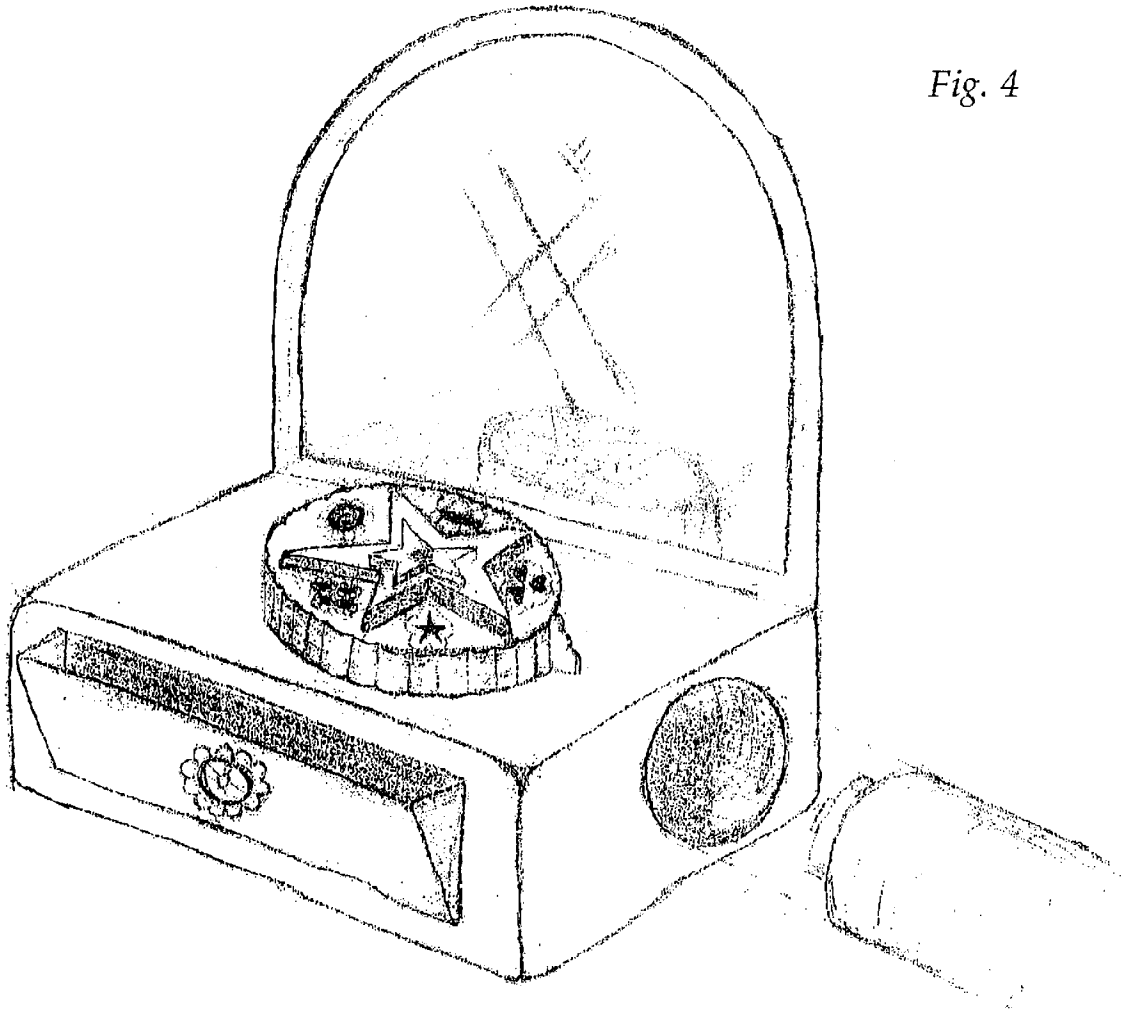
FIG. 4 shows a vanity accessory that receives the foam canister.

FIG. 4 illustrates a vanity which may include a mirror, an attachment for receiving the foam canister, and multiple extrusions for providing various shaped foam extrusions for child play.

FIGS. 5A, 5B, 5C, 5D, and 5E illustrate further embodiments showing respectively the extruded foam through an apparatus 10 which includes a soap foam canister 12, a base portion 14, and an extrusion assembly 16, herein in the shape of a cap including extrusion holes 18 from which foam 20 and 22 may be extruded as illustrated in FIGS. 5B and 5C. Also shown are appendages and facial features such as eyes 24, nose 26, mouth 28, and hands 30 discussed further below.

Figure 6A:
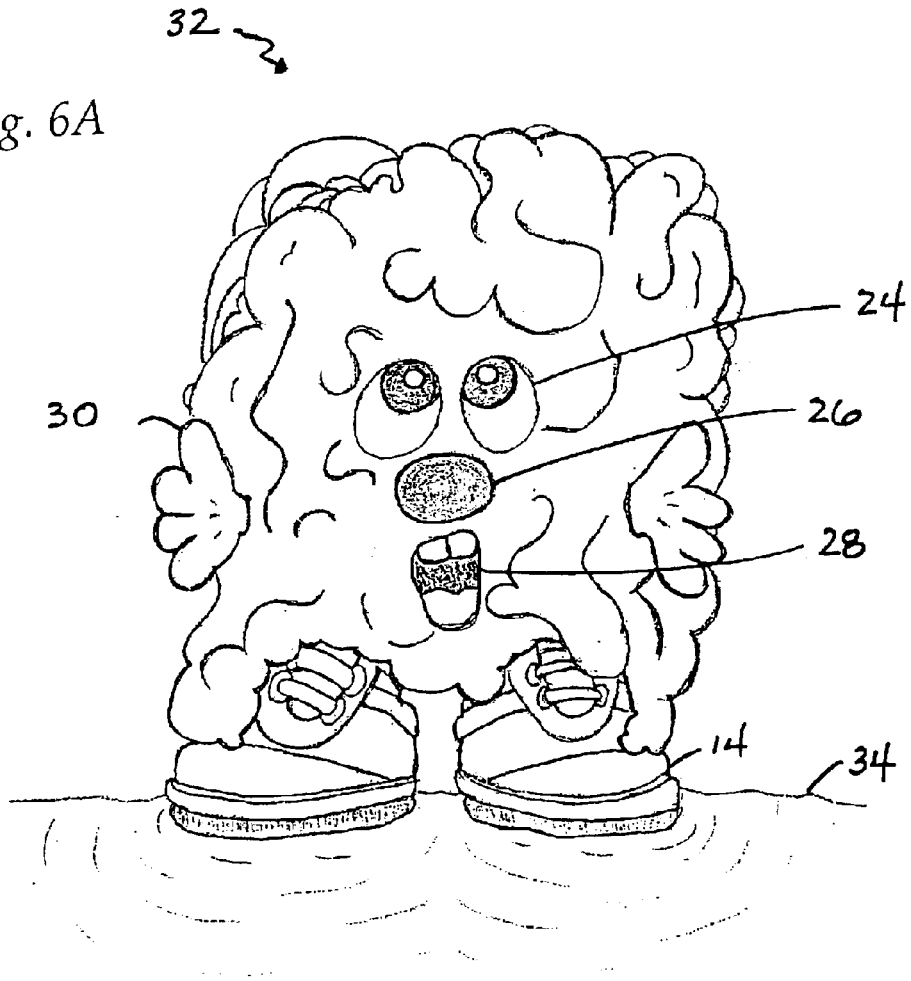
FIGS. 6A and 6B show foam sculpture model attachments for characters, animals, and various other extruded soap foam creations.
Figure 6B:
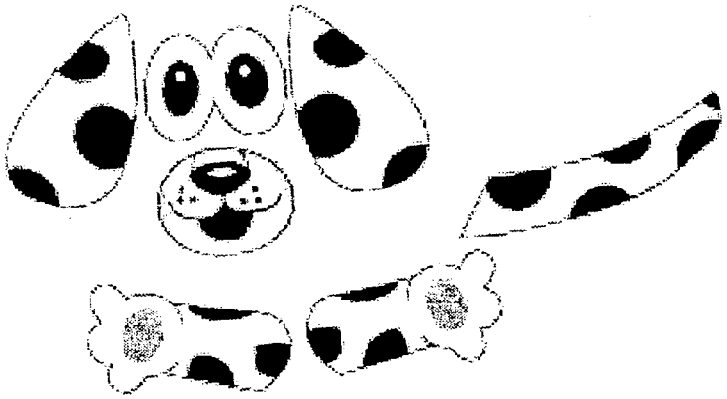

FIGS. 6A and 6B illustrate models with attachments that may be created by a child using a substantial amount of extruded foam product 32 as a sculpturing medium, herein in the form of a character set upon base 14 which may be provided for flotation upon water 34, perhaps for bath recreation. The removable facial features and appendages 24, 26, 28, and 30 are then attached to the foam sculpture.

It will be appreciated that various other embodiments of the invention may be contemplated in addition to those described and set forth in the drawings. The embodiments may include a variety of characters and play sets, such as foam product work sets and the like.

What is claimed is:

1. An apparatus for extruding foam through an orifice, comprising:

a soap foam canister;

a nozzle attached to said foam canister;

an actuator attached to said foam canister;

a cover secured to said soap foam canister having one or more orifices on the outer surface of said cover, said cover being in mechanical communication with said actuator for dispensing foam from said foam canister through said nozzle into an interior void of said cover, filling the void of the cover and thereupon further extruding the foam through the one or more orifices thereon.

2. An apparatus as recited in claim 1, further comprising an accessory play attachment that is received by the foam canister.

3. An apparatus for extruding foam through an orifice, comprising:

a foam canister;

an actuator attached to said foam canister;

a cover secured to said foam canister having one or more orifices on the outer surface of said cover;

an interior void defined within said cover;

said cover being in mechanical communication with said actuator for dispensing foam from said foam canister filling the interior void defined within said cover and extruding the foam through the one of more orifices at the outer surface of said cover.

4. A apparatus as recited in claim 3, further comprising an accessory play attachment that is received by the foam canister.

* * * * *